United States Patent [19]

Ueno et al.

[11] 4,348,841

[45] Sep. 14, 1982

[54] OUTER HEAT INSULATING STRUCTURE ON A BUILDING ROOF

[75] Inventors: Kazunori Ueno, Higashimurayama; Toru Kobayashi, Kodaira, both of Japan

[73] Assignee: Bridgestone Tire Co., Ltd., Tokyo, Japan

[21] Appl. No.: 149,594

[22] Filed: May 13, 1980

[30] Foreign Application Priority Data

May 18, 1979 [JP] Japan ..... 54-61763
Aug. 28, 1979 [JP] Japan ..... 54-117386[U]

[51] Int. Cl.[3] ..... E04D 15/00

[52] U.S. Cl. ..... 52/126.5; 52/303; 52/309.12

[58] Field of Search ..... 52/263, 126, 408, 199, 52/309.12, 302, 303

[56] References Cited

U.S. PATENT DOCUMENTS 4,232,499 11/1980 Bauch et al. ..... 52/309.12
4,258,516 3/1981 Mori et al. ..... 52/126

FOREIGN PATENT DOCUMENTS 2742444 3/1979 Fed. Rep. of Germany ..... 52/408
659699 4/1979 U.S.S.R. ..... 52/199

*Primary Examiner*—Carl D. Friedman
*Attorney, Agent, or Firm*—Sughrue, Mion, Zinn, Macpeak & Seas

[57] ABSTRACT

An outer heat insulating structure on a building roof comprises a plurality of covering layer panels provided with a heat insulating layer and female screw members secured at corner portions in the covering layer panel in alignment with through-apertures provided therein with threaded rods capable of being threadedly engaged with the female screw members. Rubbery elastic members are arranged on a waterproof layer provided on the building roof and members which are secured to the rubbery elastic members and support rotatably lower ends of the threaded rods. A heat insulating layer is defined between the covering layer panel and the waterproof layer.

4 Claims, 8 Drawing Figures

OUTER HEAT INSULATING STRUCTURE ON A BUILDING ROOF

The present invention relates to a heat insulating structure provided at outside of a roof and particularly to a structure forming a heat insulating layer at outside of a roof of a concrete building.

The saving of resources and energy has now become a great problem and this is applies in buildings.

In recent building construction, the reduction of energy for cooling and heating has been contemplated by applying a heat insulating treatment to the building. Such heat insulating treatment is very effective for improving the dwelling environment and increasing the durability of the buildings by preventing the movement of buildings due to temperature variation as well as the saving of resources and energy. For such heat insulating treatment of the buildings, particularly the heat insulating treatment on a roof of concrete buildings, an outer heat insulation wherein a heat insulating layer is formed at the outside of roof slabs and an inner heat insulation wherein a heat insulating layer is formed at the inside of roof slabs are included. The former outer heat insulation has merit in that the heat load of the roof slabs is low and that the amount of heat accumulated in the slabs in summer is small, and therefore this outer heat insulation has been more preferable than the inner heat insulation.

When the outer heat insulation is conducted, a waterproof layer is preferably arranged at the outside of the roof, so that the heat insulating layer is provided on the waterproof layer in order to prevent breakage and heat deterioration of the waterproof layer. Further a covering layer is arranged on the heat insulating layer in order to obviate problems, such as influences owing to damage, aging, ignition and air pressure of the heat insulating layer.

However, in such outer heat insulation, the arranged covering layer makes it difficult to repair and inspect the heat insulating layer, waterproof layer and the like and the formation of the covering layer is difficult. In the case of wet construction at building site, there is a problem that the waterproof layer is damaged by trowels and other tools and further the heat insulating layer, the waterproof layer and the building site are stained.

The present invention aims at to advantageously solve these problems.

The present invention will be explained in more detail in the accompanying drawings and the description of the preferred embodiment that follow.

BRIEF DESCRIPTION OF THE DRAWING

For a better understanding of the invention, reference is taken to the accompanying drawings, wherein.

DESCRIPTION OF THE PREFERRED EMBODIMENT

Figure 1:
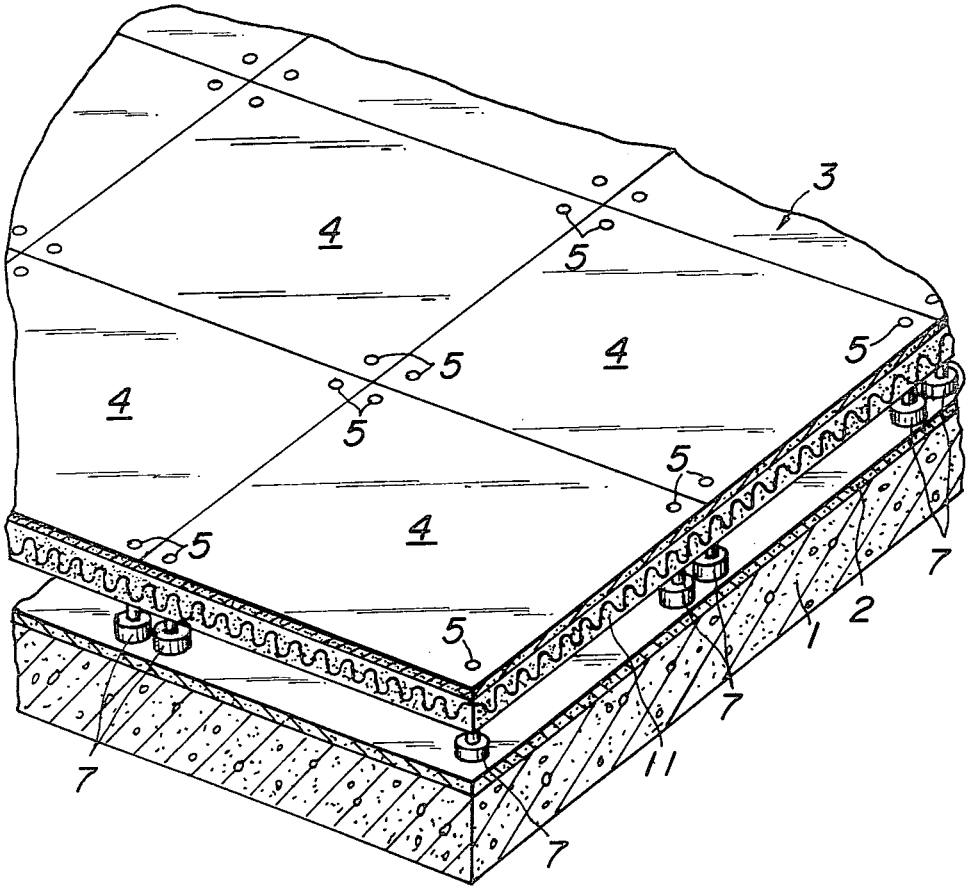
FIG. 1 is a perspective view of an embodiment of the present invention showing a part thereof in cross-section.

Referring to FIG. 1, a numeral 1 is a base layer on a roof composed of concrete and other materials, a numeral 2 is a waterproof layer covering this base layer and a numeral 3 is a covering layer wherein a heat insulating layer is provided at outside of the waterproof layer.

The covering layer 3 is square in the plane shape and has the following construction. At through-apertures 5 provided at at least corner portions of the covering layer panels 4 arranged regularly longitudinally and transversally, female screw members 6 are secured (see FIG. 2). At apertures 8 of cylindrical rubbery elastic members 7 arranged on the upper surface of the waterproof layer 2, supporting metal members 9 are secured (see FIG. 2) provided with a supporting portion having a U-shape in the cross-section and a flange portion contacting against an upper surface of the rubbery elastic member 7. Threaded rods 10 threadedly engage with the female screw members 6 and are screwed in from the upper side of the covering layer panel 4. A heat insulating material 11 composed of, for example, a rigid urethane foam is provided at the back of the panel 4.

Figure 2:
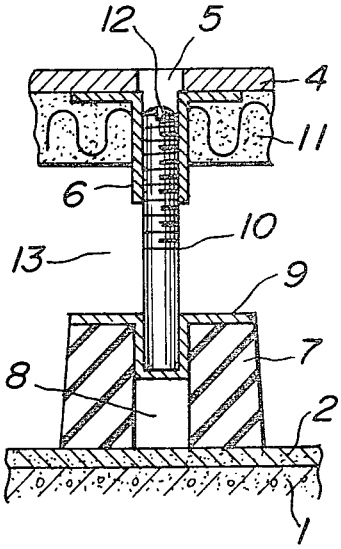
FIG. 2 is a cross-sectional view showing the structure for supporting a covering layer panel.

FIG. 2 is an enlarged cross-sectional view showing the relation of the covering layer panel, the heat insulating material and the rubbery elastic member. As shown in FIG. 2, the threaded rod 10, provided with a driver engaging slit at the top end, is screwed in the female screw member 6 fixed at the back of the panel 4 at the position in alignment with the through-aperture 5 from the upper side of the female screw member. The lower end of the screw member 6 abuts against the supporting member 9, whereby the heat insulating material layer 11 and an air layer 13 are formed as a heat insulating layer between the panel 4 and the waterproof layer 2. The thickness of the air layer 13 may be properly selected by varying the distance between the elastic member 7 and the panel 4, that is between the waterproof layer 2 and the panel 4 by adjusting the degree of the threaded rot 10 screwed.

The heat insulating layer constructed with the heat insulating material layer 11 and the air layer 13 very effectively acts as heat insulation of the building but does not adversely affect any piping arranged on the waterproof layer. Furthermore, the rubbery elastic members 7, when the thus constructed covering layer 3 is arranged afterward on the waterproof layer 2, advantageously not only protect the waterproof layer 2 from damage, but also protect the waterproof layer 2 from impact and load applied to the panel 4. They further contribute to heat insulation of the building as a heat insulator.

Figure 3:
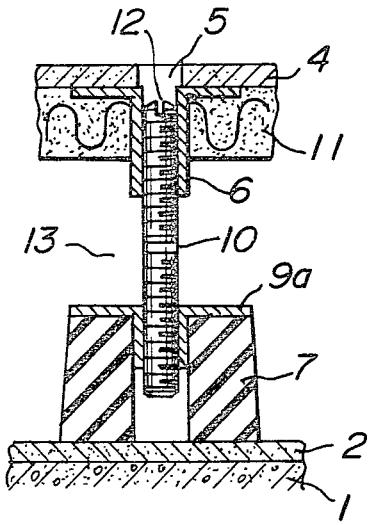
FIG. 3 is a cross-sectional view showing another embodiment of the structure shown in FIG. 2.

FIG. 3 is a vertical cross-sectional view showing a modified embodiment of the structure shown in FIG. 2, in which each of the upper and lower half portions of the threaded rod 10, have reversely directed screw threads respectively and instead of the supporting metal member shown in FIG. 2, a plastic, metal or other female screw member **9*a* is provided. In this embodiment, the desired displacement of the panel 4 can be obtained with half of revolutions of the threaded rod 10 shown in FIG. 2**.

Figure 4:
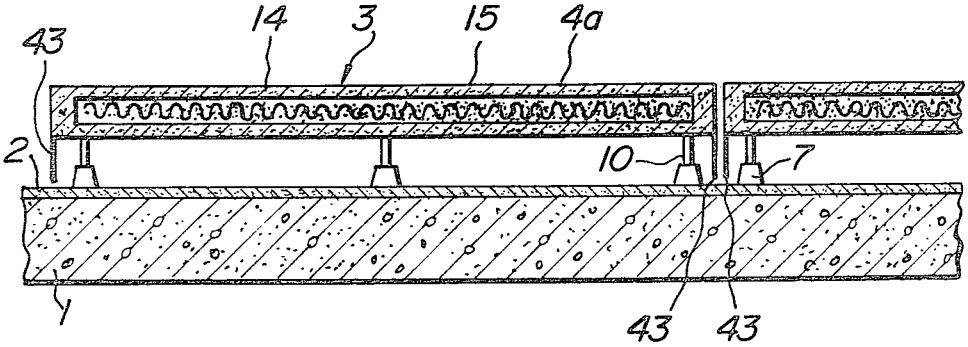
FIGS. 4–8 are cross-sectional view showing modified embodiments of the present invention.

FIG. 4 is a cross-sectional view showing a modified embodiment of the present invention, in which the covering layer panel and a heat insulating material are integrally constructed. Specifically, in this embodiment, a glass fiber reinforced cement 15 is covered with an organic foamed heat insulating material 14 to integrate both the materials, whereby a composite covering layer panel **4*a*** housing a heat insulating material is formed.

The covering layer panel has an enough weight to endure air pressure on the roof and is not broken due to a man walking, and metal, plastics, FRP (fiber glass reinforced plastic), rubber, resin mortar and other plates may be used but by using this composite covering layer panel 4*a,* particularly the high strength and the heat insulating effect for a long time of period can be obtained.

Figure 5:
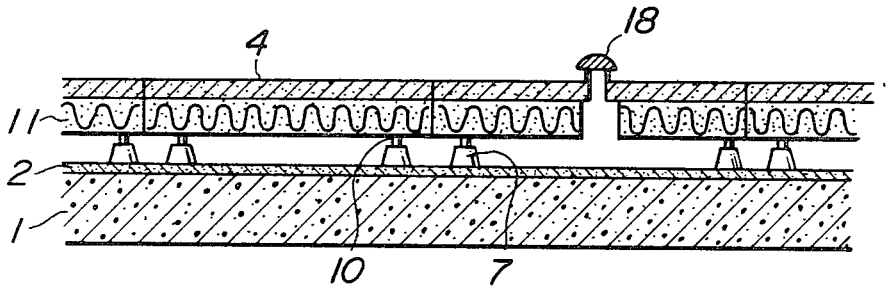

FIG. 5 is a cross-sectional view showing a further modified embodiment of the present invention, in which the heat and moisture retained in the heat insulating layer can be exhausted by providing an exhausting mechanism 18 at at least one of the panels.

Figure 6:
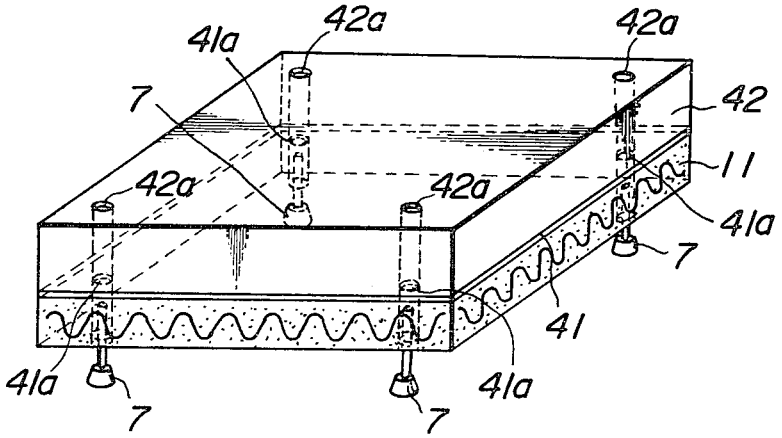
Figure 7:
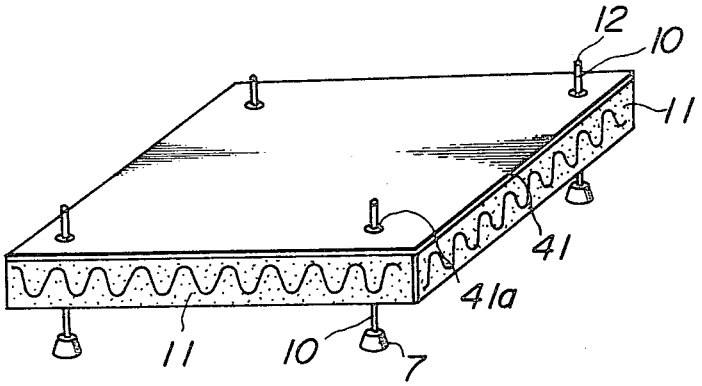

FIG. 6 shows an embodiment wherein the covering layer panel comprises a supporting panel 41 provided with through-apertures 41*a* and a concrete slab 42 superposed on the supporting panel 41 also provided with through-apertures 42*a* in alignment with the apertures 41*a.* As shown in FIG. 7, a plane supporting panel 41 composed of an iron plate, plastic plate, FRP plate and the like is used as a support for mounting the concrete slab 42. The concrete slab 42 is formed through a wet moulding process or an instant slipping process in which concrete is compacted by vibration and compression by means of a molding machine called a "block machine". At the panel 41 have been provided through-apertures 41*a* at the vicinity of each corner thereof and through-aperture 42*a* in alignment with the apertures 41*a* are provided in the concrete slab 42.

In such a working process using the supporting panel 41, the building-up of the heat insulation structure may be accomplished by arranging only the supporting panel 41 by adjusting the screwed degree of the threaded rod 10 and then mounting the concrete slab 42 provided with aperture 42*a* at the back surface on the supporting panel 41. Therefore in this case, the aperture 42*a* does not necessarily penetrate through the concrete slab 42.

Figure 8:
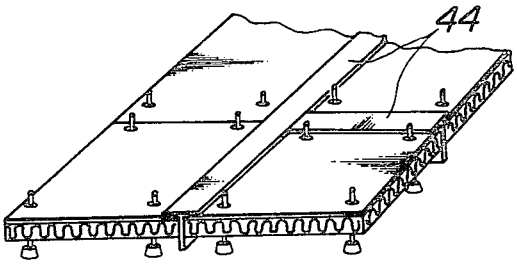

Furthermore, in the present invention, it is desirable in order to more increase the heat insulating ability to prevent as far as possible the flow of drafts generating between the panels and for the purpose, it is preferable to provide skirt members 43 at edge portions of the supporting panels as shown in FIG. 4 or to insert T-formed bars 44 between the panels at a proper distance when as shown in FIG. 8 building-up the panels.

As mentioned above, according to the present invention, the heat insulating layer is formed of a heat insulating material and an air layer, so that an excellent heat insulating effect can be obtained and the thickness of the heat insulating layer can be easily controlled from the upper surface of the covering layer panel and the maintenance and inspection of the heat insulating layer and the waterproof layer can be easily conducted by simply removing the panels. Furthermore, the formation of the heat insulating layer is very easy and the waterproof layer is not measurably damaged when the heat insulating layer is formed. Finally, staining of the working building site as in the wet field working does not occur.

What is claimed is:

1. An outer heat insulating structure on a building roof comprising; a plurality of covering layer panels formed by superposing concrete slabs on supporting panels made of a heat insulating material and adjacently arranged with one another and provided with through-apertures, female screw members secured to the supporting panels to be in alignment with said through-apertures, threaded rods capable of being threadedly engaged with the female screw members, rubbery elastic members arranged on a waterproof layer provided on the building roof, said rubbery elastic members each provided with aperture supporting members secured to the rubbery elastic members to rotatably support lower ends of the threaded rods, said threaded rods engaging said female screw members and lower ends of said rods supported by said supporting members secured in said rubbery elastic members wherein an air space is formed between the supporting panels and the waterproof layer by adjustment of the threaded rods.

2. An outer heat insulating structure on a building roof as claimed in claim 1, wherein a female screw member is secured at the rubbery elastic member and reversely directed screw threads are provided at each of the upper and lower half portions of the threaded rod respectively.

3. An outer heat insulating structure on a building roof as claimed in claim 1, wherein an exhausting mechanism is provided at at least one of a plurality of covering layer panels.

4. An outer heat insulating structure on a building roof as claimed in claim 1, further comprising skirt members at edge portions of the covering layer panel to cover openings to said air space.

* * * * *